United States Patent [19]

Yoshida

[11] 4,416,247

[45] Nov. 22, 1983

[54] DOMINO TOPPLING TOY

[75] Inventor: Takashi Yoshida, Tokyo, Japan

[73] Assignee: Yoshida Kogeisha, Tokyo, Japan

[21] Appl. No.: 384,396

[22] Filed: Jun. 2, 1982

[30] Foreign Application Priority Data

Dec. 31, 1979 [JP] Japan ..... 54-183018

[51] Int. Cl.[3] ..... F41B 15/00; A63B 71/00

[52] U.S. Cl. ..... 124/79; 46/1 R; 273/129 T

[58] Field of Search ..... 46/1 R, 128; 124/79, 124/10; 273/129 T, 129 S, 119 R

[56] References Cited

U.S. PATENT DOCUMENTS

| | | | |
|---|---|---|---|
| 2,001,449 | 5/1935 | Bergstrom | 273/129 S |
| 2,679,242 | 5/1954 | Graham | 124/79 |
| 3,315,404 | 4/1967 | Rosen | 46/1 R |

*Primary Examiner*—Mickey Yu

*Attorney, Agent, or Firm*—Armstrong, Nikaido, Marmelstein & Kubovcik

[57] ABSTRACT

There is provided a domino toppling toy which includes a movable member capable of moving toward and away with respect to the first domino piece in the domino train. The movement can be held at the position away from the first domino in a normal position and can push the first domino piece as operated to apply a toppling force thereto.

1 Claim, 2 Drawing Figures

DOMINO TOPPLING TOY

BACKGROUND OF THE INVENTION

The present invention relates generally to a domino toppling toy for making a domino toppling play more interesting and more attractive. More particularly, the invention relates to a domino toppling toy which mechanically causes to topple a first domino piece in a plurality of domino pieces arranged one after another in alignment.

A domino toppling game is one of the most popular amusements. In order to make a domino toppling game more interesting or attractive, there have been developed various appliances for use in a domino toppling game. A novel appliance has long been desired which is used for causing a first domino piece in a plurality of domino pieces arranged one after another in alignment to mechanically topple down. In other words, toppling the first domino piece is effected by indirect mechanical motion instead of causing the first domino piece to topple directly in man's hand.

SUMMARY OF THE INVENTION

Therefore, it is an object of the present invention to provide a domino toppling toy which can add more fun or interest in playing a domino toppling game.

Another and more specific object of the present invention is to provide a domino toppling toy capable of causing a first domino piece in a plurality of domino pieces arranged one after another in alignment to mechanically topple down.

To accomplish the above-mentioned and other objects of the present invention, there is provided a domino toppling toy for imparting a toppling force to a first domino piece of a domino train which comprises a movable member and an operation means. The movable member is located adjacent the first domino piece and adapted to move toward and away with respect to the first domino piece. The operation means is provided for operating the movable member to move toward and away with respect to the first domino piece in manual operation, and includes an energizing means for biasing the movable member at an initial position at which the movable member is away from the first domino piece.

The present invention will be understood more fully from the detailed description given hereinbelow and from the accompanying drawings of the preferred embodiment of the invention which, however, should not be understood as limitative to the invention but for elucidation and explanation only.

DESCRIPTION OF THE PREFERRED EMBODIMENT

Figure 1:
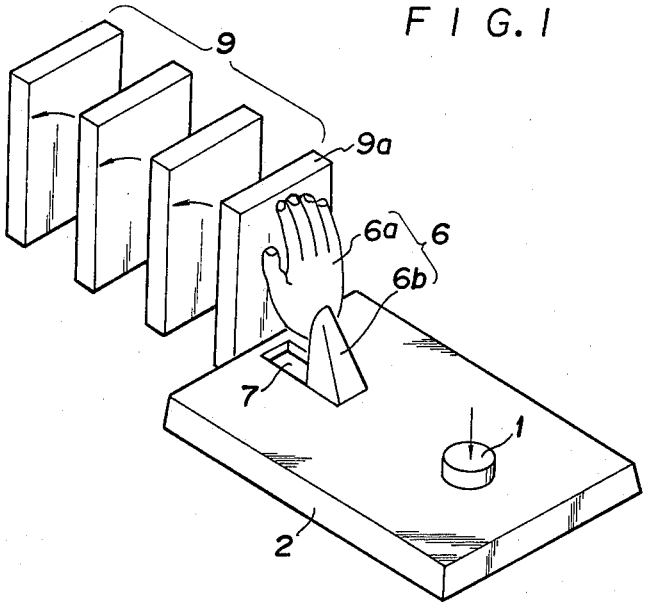
FIG. 1 is a perspective view of the preferred embodiment of a domino toppling toy in accordance with the present invention, which is shown in an arrangement actually used for toppling the first domino piece in a domino train.

Referring now to the drawings, particularly to FIG. 1, there is illustrated a preferred embodiment of the domino toppling toy according to the present invention.

The domino toppling toy is used by placing it adjacent a first domino piece 9*a* in a domino train 9. The domino toppling toy has a movable member 6 which comprises a hand-shaped head 6*a* and major section 6*b*. The major section 6*b* is substantially L-shaped configuration in section having a vertical part 6*c* and a horizontal part 6*d*. The horizontal part 6*d* is slidably placed in the internal space of a hollow rectangular housing 2. The housing 2 is formed with an elongated rectangular opening 7 on the ceiling thereof. The vertical part 6*c* of the major section 6*b* of the movable member 6 extends outwardly through the rectangular opening 7. The dimension of the rectangular opening 7 is so formed as to permit a longitudinal movement of the movable member 6 relative to the first domino piece 9*a* in the domino train 9.

Figure 2:
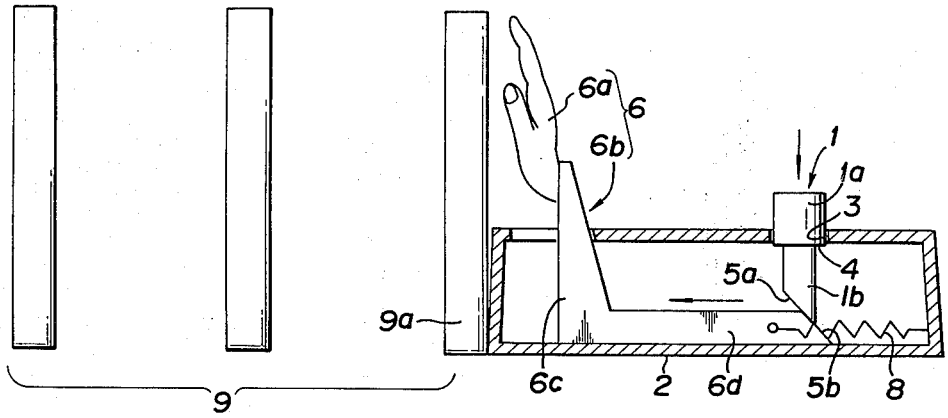
FIG. 2 is a side elevational cross section of the preferred embodiment of the domino toppling toy of FIG. 1.

As shown in FIG. 2, the movable member 6 is engaged with one end of a tension spring 8 at the end of the horizontal part 6*d* away from the vertical part 6*c*. The other end of the spring 8 is fixedly connected to the housing 2. The housing 2 is further formed with a circular opening 3 on the ceiling thereof at a spaced distance from the rectangular opening 7. A operation member 1 which comprises a manually operable head 1*a* and a driving section 1*b* having a tapered edge portion 5*a* at the lower end thereof. The horizontal part 6*d* of the movable member 6 also has a tapered edge 5*b* at the end away from the vertical part 6*c*. The tapered edge 5*b* of the horizontal part 6*d* of the movable member 6 engages with the tapered edge of the dividing section 1*b* of the operation member 1 with a tension force of the tension spring 8 applied therebetween.

In the normal position, the movable member 6 is biased by the tension spring 8 to locate the hand-shaped head 6*a* away from the first domino piece 9*a* of the domino train 9. At this initial position, the manually operable head 1*a* of the operation member 1 is depressed to urge the movable member 6 toward the first domino piece 9*a* against the tension force of the tension spring 8, so that the tapered edge 5*a* of the driving section 1*b* pushes the confronting tapered edge 5*b* of the horizontal part 6*d*. As a result, the hand-shaped head 6*a* of the movable member 6 comes in contact with the first domino piece 9*a* of the domino train 9, thereby toppling down the first domino piece 9*a* and hence sequentially the other domino pieces in the domino train 9 one by one.

After carrying out toppling of the first domino piece, the operation member 1 may be released from depressing to allow an upward movement to restore its original position. The tension spring 8, in turn, operates to move the movable member 6 to the initial position. Thus, the hand-shaped head 6*a* returns to the initial position.

In a modified embodiment of the domino toppling toy according to the invention, it may be possible to employ a coil spring around the operation member 1 to ensure a smooth return to its normal position. Furthermore, it is obvious to those artisan to replace the tension spring 9 used in the foregoing embodiment by a compression spring. In addition, the operation member 1 can be actuated not by a manual force but by another last domino piece of another domino train, the last domino piece falling down onto the operable head 1*a* of the operation member 1.

While the present invention has been illustrated in detail with respect to the preferred embodiment of the invention for better understanding, it is to be distinctly understood that the present invention is not limited thereto but may be otherwise variously embodied without departing from the scope of the following claims.

What is claimed is:

1. A domino toppling toy for imparting a toppling force to a first domino piece of a domino train consisting of a housing having a front, a back, a top and an opening in said top adjacent said front, a moveable member accommodated in said housing and moveable between a first position adjacent said front and a second position adjacent said back, said moveable member having a head portion extending through said opening and above said housing, said head portion extending horizontally beyond said front when said moveable member is in said first position, and operation means for operating said moveable member from said second position to said first position to exert said toppling force and automatically from said first position back to said second position upon removal of manual force on said means, said operation means consisting of an operation member vertically, slideably mounted through said top of said housing and having a first tapered surface on an end in said housing.

a second tapered surface on an end of said moveable member opposite to said head portion, said second tapered surface engaging with said first tapered surface, and a tension spring connected between said back of said housing and said end of said moveable member opposite to said head portion, said spring constantly urging said moveable member toward said second position.

* * * * *